US008231776B2

(12) United States Patent
Kokayeff

(10) Patent No.: US 8,231,776 B2
(45) Date of Patent: Jul. 31, 2012

(54) HYDROTREATING PROCESSES FOR FABRICATING PETROLEUM DISTILLATES FROM LIGHT FISCHER-TROPSCH LIQUIDS

(75) Inventor: Peter Kokayeff, Naperville, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 12/730,485

(22) Filed: Mar. 24, 2010

(65) Prior Publication Data

US 2010/0176028 A1 Jul. 15, 2010

Related U.S. Application Data

(63) Continuation-in-part of application No. 11/899,713, filed on Sep. 7, 2007, now abandoned.

(51) Int. Cl.
*C10G 45/00* (2006.01)

(52) U.S. Cl. ..... 208/57; 208/49; 208/58; 208/59; 208/78; 208/143; 208/144; 208/208 R; 208/209; 208/210; 208/212; 518/726

(58) Field of Classification Search ..... 208/49, 208/57–59, 78, 143–144, 208 R, 209–210, 208/212; 518/726
See application file for complete search history.

(56) References Cited

U.S. PATENT DOCUMENTS

| | | | | |
|---|---|---|---|---|
| 6,602,402 | B1 * | 8/2003 | Benazzi et al. | 208/58 |
| 6,787,022 | B1 * | 9/2004 | Berlowitz et al. | 208/18 |
| 2003/0019788 | A1 * | 1/2003 | Benazzi et al. | 208/57 |

OTHER PUBLICATIONS

Kudchadker, A.P. et al. (1966). Journal of Chemical and Engineering Data, 11(2), 253-255.*

Myers, H.S. (1947). Industrial and Engineering Chemistry, 47(9), 1659-1660.*

* cited by examiner

*Primary Examiner* — Robert J Hill, Jr.
*Assistant Examiner* — Brian McCaig
(74) *Attorney, Agent, or Firm* — Arthur E Gooding

(57) ABSTRACT

A method for obtaining a petroleum distillate product is provided, the method includes subjecting an untreated light Fischer-Tropsch liquid to a two-step hydrogenation process, each step to be carried in the presence of a catalyst comprising an amorphous substrate having a metallic composition embedded therein. After the first step of hydrogenation, an intermediate hydrotreated light Fischer-Tropsch liquid is obtained, followed by the second step of hydrogenation thereof, obtaining the petroleum distillate product as a result. An apparatus for carrying out the method is also provided.

13 Claims, 2 Drawing Sheets

HYDROTREATING PROCESSES FOR FABRICATING PETROLEUM DISTILLATES FROM LIGHT FISCHER-TROPSCH LIQUIDS

TECHNICAL FIELD

This disclosure relates generally to the processes of fabricating various petroleum-based fuels, and more specifically, to hydrogenation processes for obtaining petroleum distillate from light Fischer-Tropsch liquids.

BACKGROUND INFORMATION

Fischer-Tropsch synthesis is known to yield a broad mixture of products including primarily paraffins, and some olefins. The individual compounds of such mixture can contain up to about 200 carbons, the number of carbons between about 20 and about 150, with average number about 60 being typical. Certain quantities of oxygenated products and trace amounts of sulfur- or nitrogen containing products or aromatic compounds can be also present.

Some Fischer-Tropsch processes yield mixtures enriched with $C_5$-$C_{30}$ alkanes and also containing a significant quantity of olefins and oxygenated compounds such as alcohols or acids. Such mixtures are known as "light Fischer-Tropsch liquids" or "LFTL." Light Fischer-Tropsch liquids are frequently used as a raw material for obtaining various petrochemical products, such as, e.g., petroleum distillates, or diesel fuels, among others.

To make LFTL useful and suitable as blending stock for diesel fuel, olefins and oxygenated compounds contained therein are removed, typically by the saturation of olefins and by conversion of oxygenated compounds into water via hydrogenation also known as hydrotreating, which involves the processes of hydrogenation of LFTL in the presence of hydrogen and a catalyst.

Despite its many advantages, hydrotreating of LFTL is characterized by a number of drawbacks and deficiencies. For example, the process usually requires using very high pressures and temperatures. In addition, while traditional hydrotreating does allow for removal of olefins and oxygenated compounds, the final product often has a cloud point that is too high, limiting the amount of the product that can be blended into diesel fuels.

To avoid or lessen the effects of the above-mentioned deficiencies, as well as for the purposes of improvement of the overall process efficiency, better processes are needed to be used with light Fischer-Tropsch liquids.

SUMMARY

We provide methods for obtaining a petroleum distillate product. One method comprises subjecting an untreated light Fischer-Tropsch liquid to a first hydrogenation in the presence of a first catalyst to obtain a hydrotreated light Fischer-Tropsch liquid composite and subjecting the hydrotreated light Fischer-Tropsch liquid composite to a second hydrogenation in the presence of a second catalyst to obtain and recover the petroleum distillate product.

The light Fischer-Tropsch liquid subject to hydrogenation may be an untreated light Fischer-Tropsch liquid having the degree of unsaturation characterized by the bromine number of about 200 or below. The light Fischer-Tropsch liquid subject to hydrogenation may be also an untreated light Fischer-Tropsch liquid containing between about 1 mass % and about 20 mass % of oxygen.

The first catalyst, i.e., the catalyst used in the first step of hydrogenation process, may be a metallic composition embedded within an inorganic oxide or a zeolitic substrate, the composition comprising a base metal, e.g., a nickel-molybdenum composition or a cobalt-molybdenum composition. The metallic composition comprising the first catalyst may also include at least one noble metal, such as platinum or palladium.

The second catalyst, i.e., the catalyst used in the first step of hydrogenation process, may be a metallic composition embedded within an inorganic oxide or a zeolitic substrate, the composition comprising a base metal, e.g., a nickel-molybdenum composition or a cobalt-molybdenum composition. The metallic composition comprising the second catalyst may also include at least one noble metal, such as platinum or palladium. The first and the second catalysts may be the same or different.

We also provide a system for obtaining a petroleum distillate that subjects an untreated light Fischer-Tropsch liquid to a first hydrogenation and yields a hydrotreated light Fischer-Tropsch liquid composite, and a second hydrogenating unit that subjects the hydrotreated light Fischer-Tropsch liquid composite to a second hydrogenation and yields the petroleum distillate product.

DETAILED DESCRIPTION

Figure 1:
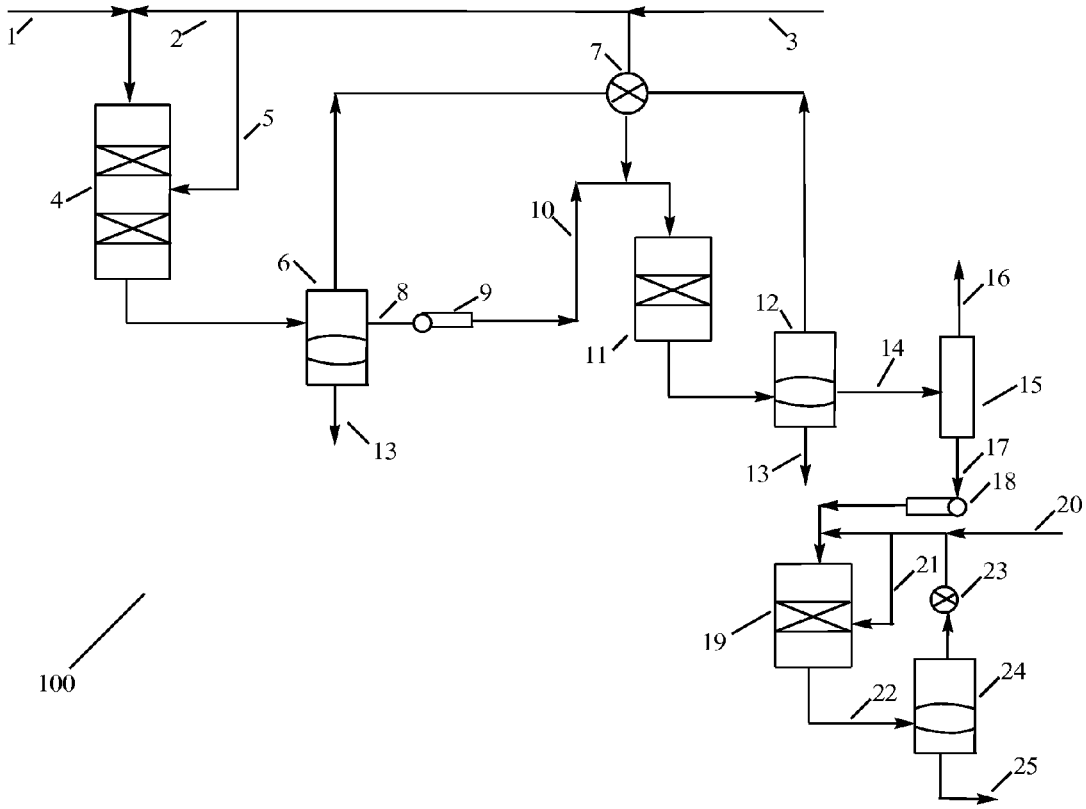
FIG. 1 illustrates schematically a system for hydrogenating of light Fischer-Tropsch liquids according to one embodiment of the present invention.

The following definitions and abbreviations are used below, unless otherwise described:

The term "a light Fischer-Tropsch liquid" or the abbreviation "LFTL" is defined as a mixture comprised of n-paraffins having the number of carbons between about 5 and about 50, the mixture containing a substantial portion of $C_5$-$C_{30}$ alkanes and also containing olefins and oxygenated compounds.

The term "a hydrocarbon" is defined as an organic compound, the molecule of which consists only of carbon and hydrogen.

The terms "a paraffin" and "alkane" are used interchangeably and refer to a hydrocarbon identified by saturated carbon chains, which can be normal (straight), branched, or cyclic ("cycloparaffin"), and described by a general formula $C_nH_{2n+2}$, where n is an integer. Paraffins or alkanes are substantially free of carbon-carbon double bonds (C=C).

The term "an olefin," also known as "alkene" is defined as a hydrocarbon containing at least one carbon-carbon double bond, and described by a general formula $C_nH_{2n}$, where n is an integer.

The terms "hydrogenation" and "hydrotreating" are used interchangeably and refer to a process of addition of hydrogen to unsaturated organic compounds, such as olefins (alkenes), typically, in a presence of a suitable catalyst, to obtain saturated organic compounds, such as alkanes, as a result.

The term "a catalyst" is defined as substance that changes the speed or yield of a chemical reaction without being itself substantially consumed or otherwise chemically changed in the process.

The term "a noble metal" refers to a metal that is highly resistant to corrosion or oxidation, and does not easily dissolve, as opposed to most base metals. Examples include, but are not limited to, platinum, palladium, gold, silver, tantalum, or the like.

The team "a base metal" refers to any non-precious metal that is capable of being readily oxidized. Examples include, but are not limited to, nickel, molybdenum, tungsten, cobalt, or the like.

The term "a bromine index" or "bromine number" indicates the degree of aliphatic unsaturation and is defined as the amount of bromine in grams absorbed by 100 grams of a sample containing an unsaturated compound, such as an olefin.

The term "a cloud point" refers to a temperature at which fuel starts congealing and starts becoming cloudy due to the appearance of wax crystals, when the fuel is tested in accordance with the American Society for Testing and Materials (ASTM) Specification D2500. The cloudiness increases as the temperature is lowered further.

The term "diesel fuel" is defined in accordance with the specifications described in the ASTM Specification D975 and refers to a petroleum fraction having containing primarily $C_{10}$-$C_{24}$ hydrocarbons and having distillation temperatures of about 160° C. at the 10% recovery point and about 340° C. at the 90% recovery point.

The term "API gravity" refers to American Petroleum Institute's measure of the density of a petroleum product relative to the density of water.

The abbreviation "WABT" means "weighted bed average temperature" and refers to an average temperature on the bed of catalyst.

The abbreviation "LHSV" means "liquid hourly space velocity" and refers to a ratio between the hourly volume of feedstock used in the process of hydrogenation and the volume of catalyst used.

The abbreviations "IBP" and "EBP" refer to the temperatures that are the initial boiling point of a product and the ending boiling point, respectively.

A petroleum distillate product may be obtained by using a two-stage process of hydrogenation. At the first stage, where most of the hydrotreating occurs, an untreated light Fischer-Tropsch liquid may be subjected to hydrogenation, which includes reacting the untreated LFTL with gaseous hydrogen, at an elevated temperature and elevated pressure, in the presence of a catalyst. During hydrogenation, the olefins that are present in the untreated LFTL react with hydrogen and become saturated by forming alkanes. If the original LFTL contained some quantity of cycloolefins, in addition cycloalkanes may be also formed. As a result, a hydrotreated light Fischer-Tropsch liquid composite is formed and water is released as a by-product.

The hydrotreated light Fischer-Tropsch liquid composite obtained as described above is then further hydrogenated to complete the process. Again, the second stage of hydrogenation includes reacting the hydrotreated LFTL, at an elevated temperature and elevated pressure, in the presence of a catalyst. Upon the completion of the process of hydrogenation, the final petroleum distillate product may be recovered. The final product is a diesel range material that may be substantially devoid of olefins and oxygenated products and may be suitable for blending with diesel fuels.

Both stages of hydrogenation may be carried out in a hydrotreating unit, or in two separate hydrogenating units, as desired. The temperature at which hydrogenation is carried out may be between about 200° C. and about 370° C., such as about 315° C. The pressure at which hydrogenation is carried out may be between about 1 MPa and about 15 MPa, for example, about 4 MPa. A desired rate of supply of hydrogen gas can be selected. For example, hydrogen gas can be supplied at a rate between about 170 and about 840 $m^3$ per 1 $m^3$ of the untreated LFTL at the first stage of hydrogenation or per 1 $m^3$ of the hydrotreated LFTL at the second stage.

Each stage of hydrogenation can be carried out under the same conditions, such as temperature, pressure, and the rate of hydrogen supply, or under the different conditions so long as the temperature and pressure are within the respective ranges disclosed above.

The process of hydrogenation can be described by the exemplary reaction schemes (1) (for straight-chained olefins such as methylbutene) and (2) (for cycloolefins such as cyclopentene):

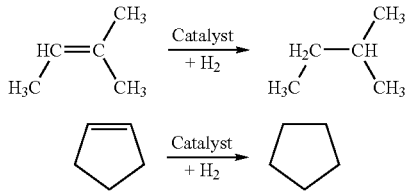

As can be seen from the reaction schemes (1) and (2), the process of hydrogenation is carried out in the presence of a catalyst. An appropriate catalyst can be selected from a variety of available options known in the art. For example, the catalyst that can be used is a base metal composition, such as a nickel-molybdenum composition, a cobalt-molybdenum composition, or the like. Alternatively, or a noble metal composition comprising, for example, platinum, palladium, or the like can be employed. The same catalyst or different catalysts can be utilized at the first and second stages of hydrogenation as discussed above.

Hydrotreating is frequently a catch-all term for numerous processes that entail treating products with hydrogen. Hydrotreating includes processes such as hydrodeoxygenation, hydroisomerization, hydrocracking, and hydrodewaxing to name a few. To one skilled in the art, it is generally apparent which particular hydrotreating process is being employed when one is studying the fluids being treated, and the resulting products, as well as operating conditions. The preferred process is briefly described in order to clarify specific hydrotreating steps in the process of producing a high grade blending stock from Fischer-Tropsch liquids.

In a preferred process, the present invention uses a two step hydrotreating procedure. The first step involves hydrotreating the LFTL over a first catalyst for the purpose of hydrodeoxygenation and partial saturation of unsaturated hydrocarbon compounds. The first catalyst is an amorphous catalyst having a metal embedded therein. The removal of oxygen from the LFTL provides protection for catalysts used in the further processing of the hydrotreated LFTL. The hydrotreated LFTL is further processed over a second catalyst for isomerization and some cracking of the hydrocarbon compounds within the hydrotreated LFTL. The second catalyst is a zeolite having a metal embedded therein. The second step comprising isomerization and some cracking improves the pour and cloud points of the liquid allowing for blending into a diesel pool or, depending on the desired degree of cracking, can produce a high quality jet fuel.

In a normal process for multistage hydrotreating of a Fischer-Tropsch liquid, the process entails hydrotreating the Fischer-Tropsch liquid over an amorphous catalyst with the primary purpose of oxygen removal from the liquid. The second step of hydroisomerization is also performed with an amorphous catalyst to provide an isomerized and deoxygenated Fischer-Tropsch liquid. This can be seen in U.S. Pat. No. 6,602,402, where the process of Benazzi et al. use amorphous catalysts for the first hydrotreating step, and the hydroisomerization step. Benazzi et al. further requires an additional step for dewaxing the hydrotreated and hydroisomerized Fischer-Tropsch liquid. The present invention does not have a hydrodewaxing step as in Benazzi et al., but overcomes drawbacks to Benazzi's second step of hydroisomerization by using a zeolitic catalyst for generating a blending stock and eliminating Benazzi's third step of dewaxing as this is accomplished in our second reactor.

Any LFTL can be used as feedstock as the starting product in the hydrogenation processes described above, including a variety of commercially available light Fischer-Tropsch liquids. The starting untreated LFTL may have distillation temperatures of about 90° C. at the 10% recovery point and about 370° C. at the 90% recovery point.

An acceptable LFTL that can be used may include a substantial quantity of paraffins, which may include one or more straight-chained paraffin(s) and may in addition include at least one branched paraffin. Such straight-chained and branched paraffin(s) are the principal components of the untreated starting LFTL. In addition to straight-chained paraffin and branched paraffin(s) the paraffin composition can further comprise at least some quantity of cycloparaffin(s).

Furthermore, the starting LFTL may have the contents of olefins that is characterized by the bromine number greater than about 10. In addition, the starting LFTL may include a quantity of oxygenated products that is characterized by the total oxygen contents between about 1 mass % and about 20 mass %. Not more than just trace amounts of any aromatic compounds, including alkyl aromatic compounds and polyalkyl aromatic compounds, may be present in the original LFTL.

The final product of the entire process of hydrogenation can be for blended with diesel fuels and with jet oil, may have the cetane number of at least about 50, and may have a cloud point of about 5° C. or less.

Various systems and apparatuses can be used for conducting our processes. One embodiment of such a system that can be used is shown by FIG. 1 and can be described as follows. FIG. 1 illustrates the system 100 comprising three hydrotreatment reactors 4, 11, and 19. All three reactors may be the same or different. In the exemplary system 100 shown by FIG. 1, the reactors 4 and 11 may use a nickel/molybdenum catalysts such as KF-647 or KF-846, and the reactor 19 may utilize a platinum/palladium catalyst. The catalysts are described in more detail in the "Examples" portion of the application, below.

The LFTL feed 1 can be mixed with the hydrogen gas 2 that can be supplied at a rate between about 170 and about 840 $m^3$ per 1 $m^3$ of the LFTL. The LFTL/$H_2$ mixture can be then pre-heated to the desired temperature (e.g., 200° C. and about 370° C., such as about 315° C.) and can be then directed to the first hydrotreatment reactor 4. The process of hydrogenation then occurs inside the reactor 4 and includes the reaction of the LFTL with hydrogen gas on a bed, such as a fixed bed, of a catalyst (not shown). As hydrogen is consumed during this process, hydrogen may be replenished from a make-up source of hydrogen 3, and hydrogen provided from this source may contain some amount of $H_2S$. The process may be carried out at a pressure between about 1 MPa and about 15 MPa, for example, about 4 MPa. The required pressure can be generated and maintained using the compressor 7.

The exothermic reactions occurring in reactor 4 may lead to a temperature increase. In order to control the temperature in the reactor the reacting fluid may be cooled (quenched). Such quenching can be achieved by supplying cool hydrogen via the by-pass line 5. Upon completion of this stage of hydrogenation, the partially hydrogenated product then may exit the reactor 4 and be directed into the separator 6, where water is separated as the stream 13. The product may exit the separator 6 via the line 8, and may then be directed to the second hydrotreatment reactor 11, using the pump 9.

In the second reactor 11, the process of hydrogenation may be continued using additional hydrogen that may be supplied via the line 10. The conditions for the second stage hydrogenation may be the same as those used for the hydrogenation in the reactor 4, as described above.

The hydrogenated product then may exit the reactor 11 and be directed into the separator 12, where water is separated as the stream 13, and the product may exit the separator 12 via the line 14, and may then be directed to the stripper 15, where the $H_2S$ gas is removed as the stream 16, and the product may exit the stripper 15 via the line 17, and may then be directed to the third hydrotreatment reactor 19, using the pump 18.

The final stage of the process of hydrogenation then occurs inside the reactor 19 and includes the reaction of the partially treated LFTL with hydrogen gas on a bed, such as a fixed bed, of a catalyst (not shown). As hydrogen is consumed during this process, hydrogen may be replenished from a make up source of hydrogen 20, where hydrogen may be typically free of $H_2S$. The process may be carried out at a pressure between about 1 MPa and about 15 MPa, for example, about 4 MPa. The required pressure can be generated and maintained using the compressor 23.

The exothermic reactions occurring in reactor 19 may lead to a temperature increase. In order to control the temperature in the reactor the reacting fluid may be cooled (quenched). Such quenching can be achieved by supplying cool hydrogen via line 21. Upon completion of this stage of hydrogenation, the partially hydrogenated product then may exit the reactor 19 via the line 22, then may be directed to the separator 24. After the process of separation, the final product can exit the system 100 as the stream 25 and then may be directed to fractionation.

Figure 2:
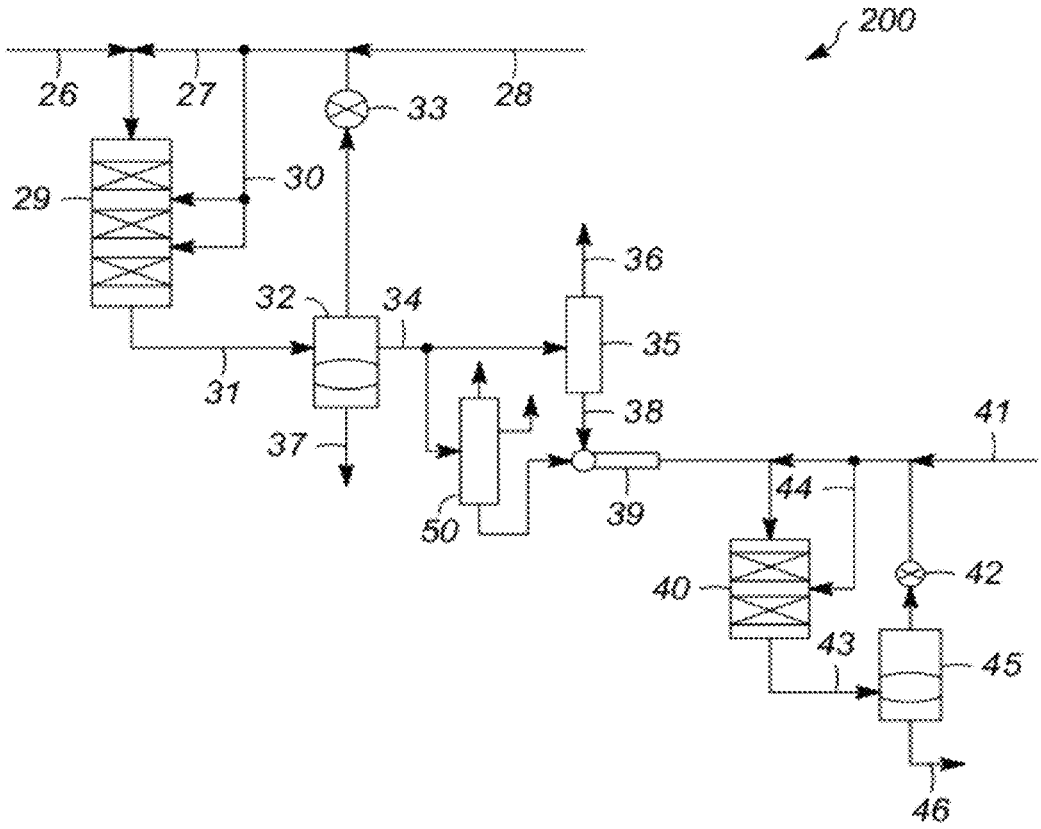
FIG. 2 illustrates schematically a system for hydrogenating of light Fischer-Tropsch liquids according to another embodiment of the present invention.

Another embodiment of a system that can be used is shown by FIG. 2 illustrating the system 200 comprising two hydrotreatment reactors 29 and 40. These reactors may be the same or different. In the exemplary system 200 shown by FIG. 2, the reactor 29 may use a nickel/molybdenum catalysts such as KF-647 or KF-846, and the reactor 40 may utilize a platinum/palladium catalyst.

The LFTL feed 26 can be mixed with the hydrogen gas 27 that can be supplied at a rate between about 170 and about 840 $m^3$ per 1 $m^3$ of the LFTL. The LFTL/$H_2$ mixture can be then pre-heated to the desired temperature (e.g., 200° C. and about 370° C., such as about 315° C.) and can be then directed to the first hydrotreatment reactor 29.

The process of hydrogenation then occurs inside the reactor 29 and includes the reaction of the LFTL with hydrogen gas on a bed of a catalyst (not shown). Hydrogen may be replenished from a make-up source of hydrogen 28, and hydrogen supplied from this source may contain some amount of $H_2S$. The process may be carried out at a pressure between about 1 MPa and about 15 MPa, for example, about 4 MPa. The required pressure can be generated and maintained using the compressor 33.

The exothermic reactions occurring in reactor 29 may lead to a temperature increase. In order to control the temperature in the reactor the reacting fluid may be cooled (quenched), which can be achieved by supplying cool hydrogen via line 30. The partially hydrogenated product then may exit the reactor 29 and be directed via the line 31 into the separator 32, where water is separated as the stream 37. The product may exit the separator 32 via the line 34, and may then be directed to stripper 35, where the $H_2S$ gas is removed as the stream 36. The product may then exit the stripper 35 via the line 38, and may then be directed to the second hydrotreatment reactor 40, using the pump 39. In an alternative, the product exiting the separator via line 34 may be directed to a fractionator 50, that separates the hydrotreated light Fischer-Tropsch liquid composite into a plurality of fractions prior to hydrogenation in the second hydrotreating reactor 40.

A later stage of the process of hydrogenation then occurs inside the reactor 40 and includes the reaction of the partially treated LFTL with hydrogen gas on a bed of a catalyst (not shown). As hydrogen is consumed during this process, hydrogen may be replenished from a make up source of hydrogen 41, where hydrogen may be typically free of $H_2S$. The process may be carried out at a pressure between about 1 MPa and about 15 MPa, for example, about 4 MPa. The required pressure can be generated and maintained using the compressor 42.

The exothermic reactions occurring in reactor 40 may lead to a temperature increase. In order to control the temperature in the reactor the reacting fluid may be cooled (quenched) by supplying cool hydrogen via the by-pass line 44. Upon completion of this stage of hydrogenation, the partially hydrogenated product then may exit the reactor 40 via the line 43, then may be directed to the separator 45. After the process of separation, the final product can exit the system 200 as the stream 46 and then may be directed to fractionation.

EXAMPLES

The following examples are provided to further illustrate the advantages and features of our processes and systems, but are not intended to limit the scope of this disclosure.

Example 1

Starting Material

The starting material that was used as a feed in hydrogenation was a commercially available light Fischer-Tropsch liquid and had the properties and characteristics shown in Table 1. In Table 1, the data for distillation temperatures show the boiling temperature at the beginning and the end of the recovery (by mass %) range. For example, the entry "10/20" in the property column and "100/142" in the value column signifies the boiling temperature of about 100° C. at the 10% mass recovery point and about 142° C. at the 20% mass recovery point.

TABLE 1

Properties of Starting Untreated LFTL

| Property | Value |
|---|---|
| Specific gravity, g/cm$^3$ | 0.7884 |
| API Gravity | 47.98 |
| Sulfur Contents, ppm*), mass | Less than 1 |
| Nitrogen Contents, ppm*), mass | 10 |
| Oxygen Contents, mass % | 5.9 |
| Bromine Index | 56 |
| Acid Number | 25.9 |
| Distillation Temperature**), ° C. | |

TABLE 1-continued

Properties of Starting Untreated LFTL

| Property | Value |
|---|---|
| IBP/5 | 21/86 |
| 10/20 | 100/142 |
| 30/40 | 167/190 |
| 50/60 | 418/454 |
| 70/80 | 266/296 |
| 90/95 | 336/373 |
| EBP | 469 |
| Contents of Aromatic Compounds, mass % | |
| One Ring | 0.8 |
| Two Rings | 0.2 |
| Three or More Rings | 1.5 |

*)parts per million
**)determined in accordance with ASTM Specification D2887
***)determined in accordance with Institute of Petroleum Test IP-391

Example 2

Hydrogenation of the Starting LFTL

The starting untreated LFTL described in Example 1 was subjected to hydrogenation. The process was carried out in a two reactor (R-1 and R-2) configuration, with the removal of water between reactors. Nickel/molybdenum catalysts KF-647 and KF-846 were used in reactors R-1 and R-2, respectively. The catalysts were obtained from Albemarle Corp. of Baton Rouge, La.

The process yielded hydrotreated LFTL composite. The conditions of the process of hydrogenation are shown in Table 2, and the properties of the product are shown in Table 3.

TABLE 2

Operating Conditions Used for Hydrogenating LFTL

| Operating Condition | Reactor 1 (R-1) | Reactor 2 (R-2) |
|---|---|---|
| Pressure, MPa | 4.14 | 4.14 |
| WABT*), ° C. | 316 | 316 |
| LHSV**), hr$^{-1}$ | 2.5 | 1.67 |
| Overall LHSV**), hr$^{-1}$ | 1.00 | |
| Recycle Gas to Reactor 1, m$^3$ per 1 m$^3$ of LFTL | 337 | |

*)weighted bed average temperature
**)liquid hourly space velocity

TABLE 3

Properties of Hydrotreated LFTL Composite

| Property | Value |
|---|---|
| Specific Gravity, g/cm$^3$ | 0.7387 |
| API Gravity | 60.04 |
| Hydrogen Contents, mass % | 15.39 |
| Bromine Index | Less than 10 |
| Oxygen Contents, mass % | Less than 0.02 |
| Acid Number | 0.005 |
| Distillation Temperature*), ° C. | |
| IBP/5 | −9/66 |
| 10/20 | 88/126 |
| 30/40 | 152/175 |
| 50/60 | 197/218 |
| 70/80 | 255/287 |
| 90/95 | 331/369 |
| EBP | 510 |

TABLE 3-continued

| Properties of Hydrotreated LFTL Composite | |
|---|---|
| Property | Value |
| Distillation Temperature**), ° C. | |
| IBP/5 | 48/85 |
| 10/20 | 103/128 |
| 30/40 | 148/167 |
| 50/60 | 189/214 |
| 70/80 | 239/Solidified |
| 90/95 | N/A (Solidified) |
| EBP | N/A (Solidified) |

*)determined in accordance with ASTM Specification D2887
**)determined in accordance with ASTM Specification D86, fractions are in volume %

The product obtained as described above and having properties shown in table 3 was then fractionated into two fractions to separate naphtha from diesel fuel. The first fraction (i.e., the naphtha fraction) had the IBP of about 149° C., and the second fraction (i.e., the diesel fraction) had the IBP above 149° C. The properties of the diesel fraction are provided in Table 4.

TABLE 4

| Properties of the Diesel Fraction (IBP > 149° C.) | |
|---|---|
| Property | Value |
| API Gravity | 53.9 |
| Cloud Point, ° C. | 12.2 |
| Flash Point, ° C. | 57.2 |
| Distillation Temperature*), ° C. | |
| IBP/5 | 168/181 |
| 10/20 | 184/192 |
| 30/40 | 203/216 |
| 50/60 | 232/249 |
| 70/80 | 268/293 |
| 90/95 | N/A//N/A (Solidified) |
| EBP | N/A (Solidified) |

*)determined in accordance with ASTM Specification D86, fractions are in volume %

As can be seen from Tables 3 and 4, in the process described above, it was not possible to complete the distillation according to ASTM Specification D86, and the diesel fraction had the cloud point which was quite high (about 12° C.), thus limiting the amount of the hydrotreated LFTL that can be used for blending into a diesel fuel. The following example demonstrates improvement of the process illustrated in Example 2.

Example 3

Further Processing of the Hydrotreated LFTL Composite

The product described in Table 3, obtained as discussed in Example 2 above (prior to fractionating the hydrotreated LFTL composite into the naphtha and diesel fractions), was further processed by additional hydrogenation, as follows.

The hydrotreated LFTL composite described in Table 3 was hydrogenated over a catalyst comprising about 0.45 mass % of platinum and about 0.45 mass % of palladium embedded on a support comprising a zeolite. The processing conditions for the process of hydrogenation are described in Table 5.

TABLE 5

| Conditions for Processing the Hydrotreated LFTL Composite by Hydrogenation over a Platinum/Palladium Catalyst | |
|---|---|
| Operating Condition | Value |
| Pressure, MPa | 6.9 |
| LHSV, $hr^{-1}$ | 1.0 |
| Hydrogen Flow, $m^3$ per 1 $m^3$ of LFTL | 1,011 |
| Temperature, ° C.*) | 265.6 |
| | 291.7 |

*)two separate experiments

As can be seen from Table 5, the process of hydrotreating was carried out at two different temperatures. Using the lower temperature, i.e., 265.6° C., may be suitable for improving the quality of the diesel fraction, while using the higher temperature, i.e., 291.7° C., may be beneficial if the product is to be used in the manufacturing of jet fuel with enhanced properties.

The product obtained under conditions shown in Table 5 was then fractionated and the light and the heavy naphtha fractions were removed by distillation. The properties of the remaining fraction are provided in Tables 6 and 7. Table 6 shows the properties of the diesel fraction that remained, as obtained after the hydrogenation carried out at the lower hydrogenation temperature of about 265.6° C.

TABLE 6

| Properties of the Diesel Fraction After Processing the Hydrotreated LFTL Composite by Hydrogenation over a Platinum/Palladium Catalyst at 265.6° C. | | | | |
|---|---|---|---|---|
| Stream | Liquid Product | IBP/85° C. | 85° C./143° C. | 143° C./EBP |
| Yield, g | 9,357 | 779 | 1,865 | 6,642 |
| Yield, mass % | N/A | 8.4 | 20.1 | 71.5 |
| API Gravity | 59.8 | 84.5 | 69.6 | 54.6 |
| Specific Gravity, $g/cm^3$ | 0.7397 | 0.6550 | 0.7036 | 0.7602 |
| Hydrogen Contents, mass % | N/A | N/A | 15.78 | 15.33 |
| Flash Point, ° C. | N/A | N/A | 2.8 | 53.9 |
| Cloud Point, ° C. | N/A | N/A | N/A | 3.9 |
| Pour Point, ° C. | N/A | N/A | N/A | −6.1 |
| Viscosity at −20° C., cSt | N/A | N/A | 1.185 | N/A |
| Iron Contents, mass % | N/A | N/A | <0.00002 | <0.00002 |
| Reid Vapor Pressure, Pa | N/A | N/A | 9,928.5 | 896.3 |
| Micro Research Octane Number | N/A | N/A | <40 | N/A |
| Micro Motor Octane | N/A | N/A | <40 | N/A |

TABLE 6-continued

Properties of the Diesel Fraction After Processing the Hydrotreated LFTL Composite by Hydrogenation over a Platinum/Palladium Catalyst at 265.6° C.

| Stream | Liquid Product | IBP/85° C. | 85° C./143° C. | 143° C./EBP |
|---|---|---|---|---|
| Number | | | | |
| Cetane Number | N/A | N/A | N/A | 73.7 |
| Distillation Temperatures*), ° C. | | | | |
| IBP | −1.1 | −9.4 | 63.9 | 139.4 |
| 5 | 66.7 | 17.8 | 87.2 | 149.4 |
| 10 | 96.7 | 30.0 | 96.7 | 150.0 |
| 20 | 126.1 | 33.3 | 98.3 | 173.9 |
| 30 | 151.1 | 35.6 | 99.4 | 195.0 |
| 40 | 173.9 | 56.7 | 105.6 | 207.2 |
| 50 | 196.1 | 67.2 | 118.9 | 223.3 |
| 60 | 216.7 | 69.4 | 126.7 | 243.9 |
| 70 | 246.7 | 70.0 | 127.8 | 270.0 |
| 80 | 273.9 | 70.6 | 128.9 | 288.3 |
| 90 | 316.1 | 70.6 | 129.4 | 329.4 |
| 95 | 356.1 | 87.2 | 141.1 | 366.7 |
| EBP | 500.6 | 97.2 | 149.4 | 475.6 |
| Distillation Temperatures**), ° C. | | | | |
| IBP | N/A | N/A | 103.9 | 166.7 |
| 5 | N/A | N/A | 107.2 | 178.3 |
| 10 | N/A | N/A | 108.3 | 178.3 |
| 20 | N/A | N/A | 109.4 | 186.7 |
| 30 | N/A | N/A | 111.1 | 196.1 |
| 40 | N/A | N/A | 112.8 | 208.3 |
| 50 | N/A | N/A | 115.0 | 222.2 |
| 60 | N/A | N/A | 117.2 | 238.3 |
| 70 | N/A | N/A | 120.0 | 257.2 |
| 80 | N/A | N/A | 123.3 | 279.4 |
| 90 | N/A | N/A | 127.2 | 315.6 |
| 95 | N/A | N/A | 130.6 | N/A |
| EBP | N/A | N/A | 143.9 | 354.4 |
| Recovery, mass % | N/A | N/A | 98.7 | 93.9 |

*)simulated, determined in accordance with ASTM Specification D2887

**)Engler distillation, determined in accordance with ASTM Specification D86

As can be seen from the data presented in Table 6, the cloud point has been substantially improved compared with that of the diesel fraction recovered from the hydrotreated LFTL composite (see Table 4 for comparison of the respective cloud points), and the cetane number is quite high. Thus, the diesel fraction characterized in Table 6 may be used for blending with various diesel fuels. It may be also noticed that the difficulties previously experienced with the ASTM D86 distillation were eliminated.

Table 7 shows the properties of the kerosene/jet fuel fraction that remained, as obtained after the hydrogenation carried out at the higher hydrogenation temperature of about 291.7° C., and demonstrates that the product can be used as a high quality jet fuel blending component.

TABLE 7

Properties of the Kerosene/Jet Fuel Fraction After Processing the Hydrotreated LFTL Composite by Hydrogenation over a Platinum/Palladium Catalyst at 291.7° C.

| Stream | Liquid Product | IBP/85° C. | 85° C./135° C. | 135° C./EBP |
|---|---|---|---|---|
| Yield, g | 4,995 | 649 | 1,307 | 2,965 |
| Yield, mass % | N/A | 13.2 | 26.6 | 60.3 |
| API Gravity | 65.1 | 85.2 | 70.0 | 58.3 |
| Specific Gravity, g/cm$^3$ | 0.7197 | 0.6530 | 0.7022 | 0.7456 |
| Hydrogen Contents, mass % | N/A | N/A | 15.78 | 15.44 |
| Total Sulfur Contents, mass ppm | N/A | N/A | <0.05 | 0.07 |
| Flash Point, ° C. | N/A | N/A | 1.0 | 43.0 |
| Cloud Point, ° C. | N/A | N/A | N/A | −35.0 |
| Pour Point, ° C. | N/A | N/A | N/A | −57.0 |
| Smoke Point, mm | N/A | N/A | N/A | 39 |
| Freeze Point, ° C. | N/A | N/A | N/A | −56.6 |
| Viscosity at −20° C., cSt | N/A | N/A | 1.137 | 3.250 |
| Iron Contents, mass % | N/A | N/A | <0.00002 | <0.00002 |
| Reid Vapor Pressure, Pa | N/A | N/A | 10,824.8 | 1,930.5 |

TABLE 7-continued

Properties of the Kerosene/Jet Fuel Fraction After Processing the Hydrotreated LFTL Composite by Hydrogenation over a Platinum/Palladium Catalyst at 291.7° C.

| Stream | Liquid Product | IBP/85° C. | 85° C./135° C. | 135° C./EBP |
|---|---|---|---|---|
| Micro RON | N/A | N/A | <40 | N/A |
| Micro MON | N/A | N/A | <40 | N/A |
| | Distillation Temperatures*), ° C. | | | |
| IBP | −22.2 | −12.2 | 63.3 | 123.3 |
| 5 | 33.9 | 16.7 | 85.0 | 140.6 |
| 10 | 72.8 | 18.3 | 87.2 | 142.3 |
| 20 | 97.8 | 32.2 | 97.2 | 151.1 |
| 30 | 117.8 | 34.4 | 98.9 | 165.0 |
| 40 | 131.7 | 52.8 | 100.0 | 174.4 |
| 50 | 151.7 | 57.2 | 115.0 | 186.7 |
| 60 | 167.8 | 66.1 | 117.8 | 196.7 |
| 70 | 187.2 | 68.3 | 125.6 | 208.3 |
| 80 | 205.0 | 69.4 | 127.2 | 221.1 |
| 90 | 227.8 | 70.0 | 128.3 | 238.9 |
| 95 | 245.0 | 83.9 | 131.1 | 253.9 |
| EBP | 286.7 | 95.6 | 148.9 | 286.1 |
| | Distillation Temperatures**), ° C. | | | |
| IBP | N/A | N/A | 101.1 | 156.1 |
| 5 | N/A | N/A | 103.9 | 164.4 |
| 10 | N/A | N/A | 105.0 | 163.9 |
| 20 | N/A | N/A | 106.7 | 168.3 |
| 30 | N/A | N/A | 107.8 | 172.2 |
| 40 | N/A | N/A | 109.4 | 177.2 |
| 50 | N/A | N/A | 111.1 | 184.4 |
| 60 | N/A | N/A | 113.3 | 191.7 |
| 70 | N/A | N/A | 116.1 | 201.1 |
| 80 | N/A | N/A | 119.4 | 212.2 |
| 90 | N/A | N/A | 123.9 | 229.4 |
| 95 | N/A | N/A | 128.3 | 247.2 |
| EBP | N/A | N/A | 141.1 | 248.3 |
| Recovery, mass % | N/A | N/A | 97.0 | 95.8 |

*)simulated, determined in accordance with ASTM Specification D2887

**)Engler distillation, determined in accordance with ASTM Specification D86

Although our methods and systems have been described with reference to the above-discussed reactions and structures, it will be understood that modifications and variations are encompassed within the spirit and scope of the disclosure as defined in the appended claims.

The invention claimed is:

1. A method for obtaining a petroleum distillate product comprising:

(a) subjecting an untreated light Fischer-Tropsch liquid having oxygenates containing between 1 mass % and 20 mass % oxygen to a hydrogenation in a first reaction zone, in the presence of a first catalyst comprising an amorphous substrate having a first metallic composition embedded therein to obtain a hydrotreated light Fischer-Tropsch liquid composite and yielding water as a by-product;

(b) subjecting the hydrotreated light Fischer-Tropsch liquid composite to a hydrogenation for isomerization and cracking in a second reaction zone, in the presence of a second catalyst comprising a molecular sieve substrate or a zeolite having a second metallic composition embedded therein to obtain the petroleum distillate product; and (c) recovering the petroleum distillate product, wherein the untreated light Fischer-Tropsch liquid has distillation temperatures of about 90° C. at the 10% recovery point and about 370° C. at the 90% recovery point.

2. The method of claim 1, wherein each of the first metallic composition and the second metallic composition comprises a base metal composition or a noble metal composition.

3. The method of claim 2, wherein the base metal composition is at least one selected from the group consisting of a nickel-molybdenum composition, a cobalt-molybdenum composition, and a nickel-tungsten composition.

4. The method of claim 2, wherein the noble metal composition comprises at least one noble metal selected from the group consisting of platinum and palladium.

5. The method of claim 1, wherein the first metallic composition and the second metallic composition are the same or are different.

6. The method of claim 1, wherein the bromine number of the untreated light Fischer-Tropsch liquid is 200 or below.

7. The method of claim 1, wherein the hydrogenation in each of the first reaction zone and the second reaction zone are carried out at a pressure between about 1 and about 15 MPa.

8. The method of claim 1, wherein the hydrogenation in the second reaction zone is carried out at a temperature between about 200° C. and about 370° C.

9. The method of claim 1, wherein hydrogenation in the second reaction zone includes supplying hydrogen at a rate of between about 170 and about 840 $m^3$ per 1 $m^3$ of the hydrotreated light Fischer-Tropsch liquid composite.

10. The method of claim 1, wherein the petroleum distillate product comprises a diesel blending component having the cetane number of at least 50.

11. The method of claim 1, wherein the petroleum distillate product is suitable for blending with jet fuel.

12. The method of claim 1, wherein the petroleum distillate product has a cloud point of about 5° C. or less.

13. The method of claim 1, wherein recovering of the petroleum distillate product removes the water.

* * * * *